US005947785A

United States Patent [19]

Bausch

[11] Patent Number: 5,947,785

[45] Date of Patent: Sep. 7, 1999

[54] FLYING WING TOY

[76] Inventor: Luc Bausch, 2341 Palos Verdes Dr. West, No. 6, Palos Verdes, Calif. 90274

[21] Appl. No.: 08/977,725

[22] Filed: Nov. 25, 1997

[51] Int. Cl.[6] ..... A63H 27/01; A63H 27/22

[52] U.S. Cl. ..... 446/59; 446/34; 446/36; 446/61; 446/66

[58] Field of Search ..... 446/44, 59, 62, 446/34, 36, 61, 66

[56] References Cited

U.S. PATENT DOCUMENTS

| | | | |
|---|---|---|---|
| D. 37,685 | 11/1905 | Arlington . | |
| D. 55,102 | 5/1920 | Van Shrum . | |
| 1,287,779 | 12/1918 | Springer | 446/44 |
| 1,708,823 | 4/1929 | Arzig . | |
| 2,138,168 | 11/1938 | Horak . | |
| 2,308,916 | 1/1943 | Halligan . | |
| 2,410,627 | 11/1946 | Brand . | |
| 2,439,143 | 4/1948 | Nemeth . | |
| 2,543,516 | 2/1951 | Walker | 446/59 |
| 3,174,252 | 3/1965 | Sunray | 446/59 |
| 3,430,899 | 3/1969 | Zopf | 446/62 |
| 3,479,764 | 11/1969 | Meyer . | |
| 3,540,149 | 11/1970 | Lowe . | |
| 3,768,198 | 10/1973 | Fields . | |
| 3,909,976 | 10/1975 | Kirk . | |
| 3,943,657 | 3/1976 | Leckie | 446/62 |
| 4,388,777 | 6/1983 | Hermann . | |
| 4,863,413 | 9/1989 | Schwarz | 446/62 |
| 4,904,219 | 2/1990 | Cox . | |
| 4,988,320 | 1/1991 | Rankin . | |

OTHER PUBLICATIONS

Chanute, Octave, *Progress in Flying Machines,* pp. 141–148, Lorenz & Herweg, Long Beach, CA 1976.

*Primary Examiner*—Kien T. Nguyen
*Assistant Examiner*—Kurt Fernstrom
*Attorney, Agent, or Firm*—Fulwider Patton Lee & Utecht, LLP

[57] ABSTRACT

A flying wing toy including a rigid planar body, a wing of flexible sheet material affixed to the body and preshaped with flexible leading and lateral edges and flexible, flanking stabilizers extending rearwardly, a propeller rotatably mounted to the front end of the body, and a manually actuated rotational drive unit comprising an elastic member mounted on the body and coupled to the propeller.

27 Claims, 4 Drawing Sheets

FLYING WING TOY

BACKGROUND OF THE INVENTION

1. Field of the Invention

The present invention relates to a flying toy, and more particularly to a vertically ascending, wing shaped airplane.

2. Description of the Prior Art

Toys have long been an integral and important part of childhood. Playing with toys offers a simple pleasure that is shared by young and old alike. Besides providing hours of enjoyment, toys also challenge children to exercise and develop their imagination. A growing number of toys are being designed to fulfill an educational purpose as well by teaching children various social and scientific concepts and notions in a fun, noncompetitive environment. Spinning tops, building blocks, toy automobiles and airplanes can teach a child a wide variety of physical concepts, and such toys are increasingly being used as part of classroom instruction to teach relatively advanced concepts involving aerodynamics, fluid dynamics, materials science, and application of the basic laws of physics.

Toy airplanes in particular have been extremely popular both for their entertainment and educational value, and a large number of designs have been developed over the years. The first designs were simplistic gliders formed from folded sheets of paper that were thrown by the user into the air to glide back down to the ground. An early example of such a glider is disclosed in U.S. Des. Pat. No. 55,102 to Van Shrum, wherein the single drawing depicts a flying toy contoured in a shape reminiscent of a butterfly with tapered wings and rearwardly projecting elements symmetrically disposed about a central longitudinal axis. Another design for a glider is disclosed in U.S. Pat. No. 2,410,627, wherein a flat body formed to resemble the head and body of a bird is attached to a sheet of paper shaped to resemble the wings and tail of a bird to form a glider. The glider is thrown into the air and is described as being able to glide through the air for a comparatively considerable distance. U.S. Pat. No. 3,540,149 to Lowe discloses a very similar glider that includes a pair of wings shaped like bird's wings, a fuselage shaped like a bird's head, body and tail, and a weighted strip mounted to the fuselage. A second weighted strip reinforces the wing structure, holds the wings at a predetermined dihedral angle, and further adds weight near the center of gravity of the glider.

U.S. Pat. No. 3,909,976 to Kirk also discloses a glider toy that incorporates a weight member that is located forward of the glider's center of gravity. The glider is contoured with a outwardly convex leading edge and two long, trailing leg sections that can bent to various angles relative to the body. The flight path of the glider can thus be altered by bending these leg sections, or by throwing the glider into the air with a twisting motion to cause it to flip from side to side during flight. This glider is designed primarily to be used indoors by being thrown in the manner of a dart. U.S. Pat. No. 4,388,777 discloses a toy sailplane suitable for outdoor use which incorporates a single piece, swept back wing with a weight suspended from its lower surface. The wing is shaped to respond to changes in wind by alternately soaring or gliding, and is described as being able to fly for an extended period of time. The position of the suspended weight is adjustable and can thus be used to vary the center of gravity of the toy and thereby change the angle of attack of the wing.

The sophistication of models such as those described above grew as lighter and stronger materials became available, and with the advent of the now ubiquitous rubber-band, powered flight became possible. A simple and straightforward method of harnessing the resilient power of a rubber-band is to hook a glider to one end of a rubber band, stretch the rubber band, then release it in slingshot fashion to launch the glider with a higher launch velocity than typically achieved by manually throwing the glider into the air. This is the concept behind the glider disclosed in U.S. Pat. No. 3,768,198 to Fields, wherein one or more sheets of foldable material are shaped into wing and body sections and clamped together with a bent piece of wire which extends downwardly into a hook configuration to engage a rubber band for launching the plane. In a much more sophisticated design, Schwarz discloses in U.S. Pat. No. 4,863,413 a bird shaped toy glider including a body with a laminated head structure incorporating a metal weight and a collapsible wing structure mounted on the body. In operation, the wings are collapsed and the glider is launched in slingshot fashion by a rubber band to climb until its speed drops below a predetermined speed, allowing a rubber band mounted to the wing structure to expand the wing into a deployed position to glide the toy throughout its descent.

The devices described above and others like them are enjoyable to watch and can be employed to teach students many fundamentals of flight dynamics. In addition, they are all relatively inexpensive to produce. However, none of these designs addresses one of the most exciting developments in flight of the past few decades, the vertically ascending helicopter. A helicopter is a relatively complex device, and consequently can teach a different set of principles to students attempting to model its operation. To many, the flight of a helicopter is more entertaining to watch than a glider, and thus a number of toy designs have been developed that mimic a helicopter's mode of operation. U.S. Pat. No. 1,287,779 to Springer, for instance, discloses a device comprising a wing mounted to a frame equipped with a rubber band powered propeller. A second rubber band is mounted to a second frame that slidingly engages the first frame and causes the entire device to jump in the air when stretched and released, at which time the propeller begins to rotate and causes the device to fly over a horizontal flight path of some distance. In U.S. Pat. No. 2,308,916, Halligan discloses a flying toy that ascends and descends vertically and includes a body with a vertical mast upon which a horizontal propeller is rotatably mounted. Two vertically positioned propellers are rotatably mounted on opposite sides of the horizontal propeller and are powered by a rubber band connected between them. As the vertical propellers begin to turn, they cause the horizontal propeller to turn as well, thereby creating vertical thrust to lift the toy off the ground and ascend vertically. While very amusing and entertaining, neither of these devices fully and correctly mimics the actual operating principles of a helicopter and are therefore of limited educational use.

Nemeth in U.S. Pat. No. 2,439,143 discloses a toy helicopter equipped with a rubber band powered propeller that causes it to ascend vertically and counter rotating vanes to stabilize the device during ascent. The body of the device supports a mast upon which the propeller and the vanes are mounted. A slightly different approach is taken by Horak in U.S. Pat. No. 2,138,168, wherein a toy rocket is disclosed to include a conical body with an upwardly projecting hollow mast supporting a stationary propeller and a rotating propeller powered by a rubber band extending within the mast. The two propellers have blades with opposite pitch and thus during flight rotate in opposite directions to lift the toy along a stable vertical path. The conical body helps guide the rocket, and at the apex of the flight path causes it to rotate towards the ground so as to land on the hub of the rotating propeller. In yet another variation, U.S. Pat. No. 3,479,764 to Meyer discloses a toy consisting primarily of a hollow shaft containing a rubber band within that is attached to counter-rotating propellers mounted to opposite ends of the shaft, and a device for locking one of the propellers in place while the other propeller is being turned to twist the rubber band drive and thereby store energy to be released during flight.

These devices are relatively similar to each other and describe toys that both ascend and descend vertically, thus creating the potential for damaging the device and injuring the users or bystanders. This problem was solved partially by M. Dandrieux as early as 1879 with a device comprising a thin flexible wing attached to, and symmetrical about, a longitudinal member with a propeller rotatably mounted to its forward end and a rubber band attached between a rear end and the propeller at the forward end. (see *Progress in Flying Machines* by Octave Chanute, pp. 142–143, Lorenz & Herweg 1894, reprinted 1976). The propeller and the wing are both formed with rigid leading edges and elastic posterior edges, and the propeller has practically no pitch except that imposed by the resultant air pressure upon the flexible trailing edge of the propeller during rotation. The overall shape of the wing is reminiscent of a butterfly, with outwardly convex posterior and anterior edges, and the wing material is specified as being mounted quite loosely upon the frame so as to undulate when under forward motion. The device is described as being quite erratic in flight, seldom pursuing the same course twice, rising to a maximum height of 20–30 feet and then gliding back down to the ground sustained by the wing alone. As a toy, this device is entertaining, providing an overall vertical, helicopter-like ascent followed by a glide to the ground in the manner of an airplane or glider. It is also apparent that such a toy has considerable educational value, in that it illustrates a wide variety of physical and aerodynamic principles in action.

However, this device was reported as providing less than ideal performance with an erratic flight path and a rather limited vertical range. What is needed is a device that preserves the simplicity and affordability of this design but offers stable aerodynamic performance in both the vertical ascent and the gliding descent flight regimes. Such a device would preferably be formed from lightweight, inexpensive materials that are easy and safe to work with, thus lending themselves to use in the classroom.

SUMMARY OF THE INVENTION

The present invention provides a toy including a thin, flexible wing mounted to a lightweight, rigid body. A rubber-band powered propeller is rotatably attached to the front of the body forward of the leading edge to propel the toy into vertical ascent. The wing is formed with a flexible leading edge and flexible trailing extensions to stabilize the unpowered descent of the device into a smooth, graceful glide path.

The present invention preferably includes an anchor at the rear of the body to secure the rubber band during ascent and impart counter rotational motion to the wing reactive to the propeller. Accordingly, it is an object of the present invention to provide a flying wing toy that is powered by a rubber band driven propeller for generally vertical ascent and that, when the rubber band is unwound, glides back down in a generally horizontal descent.

It is another object of the present invention to be easy to assemble and operate, inexpensive, and durable to withstand use by children. It is yet another object of the present invention to provide at least one surface upon which the user can imprint various indicia and other decorations.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENT

Toy airplanes and gliders have broad appeal not just as playthings but also as a fun and entertaining way of instructing children in the laws of physics and aerodynamics. Powered toy gliders are more entertaining but also more complex and, consequently, of even greater educational value. Rubber bands are cheap, safe, resilient, and the power source of choice for such flying gliders. In addition, rubber bands can provide sufficient torque to power toys that ascend vertically in the manner of a helicopter, to the much enhanced delight of children and other bystanders. Such vertically ascending toys, however, typically display an equally vertical, and rather uninspiring, descent when the rubber band has finished unwinding.

Figure 1:
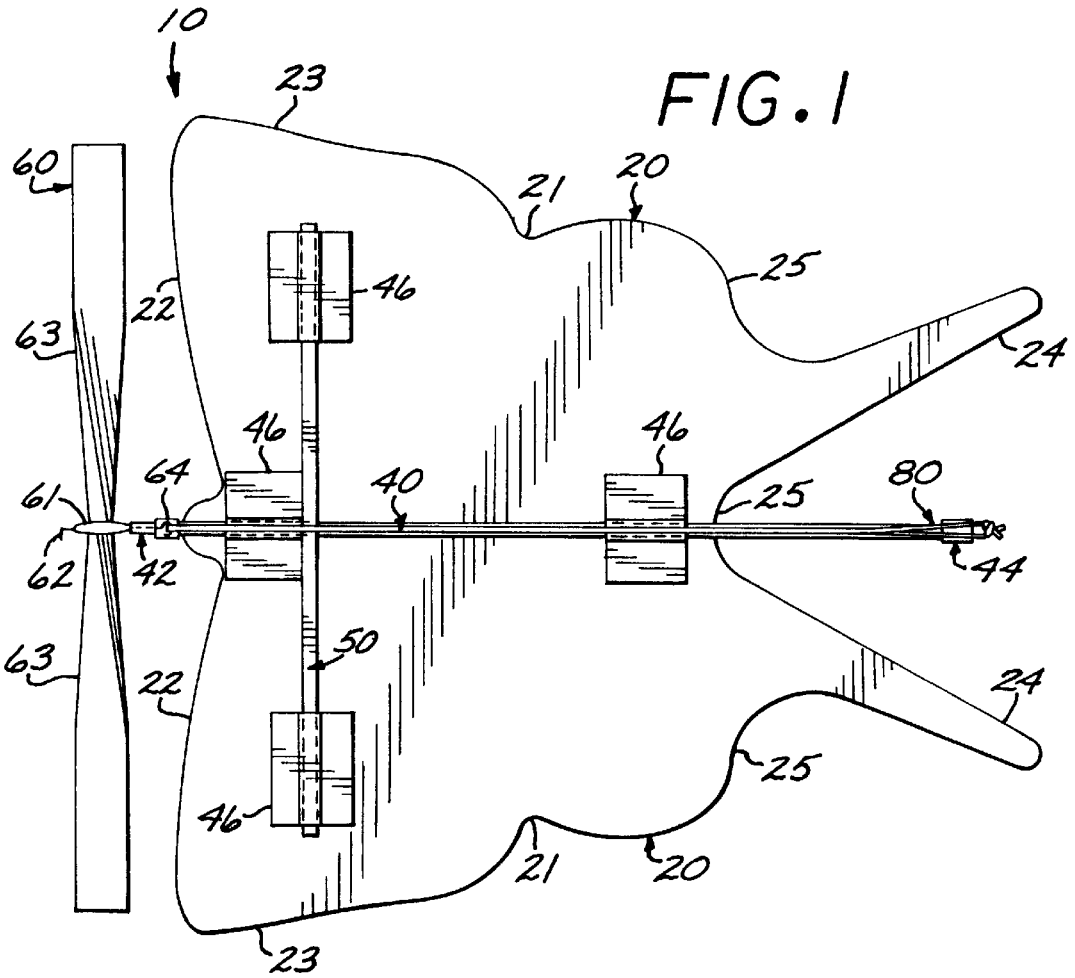
FIG. 1 depicts a top plan view of a flying wing toy embodying the present invention.

The toy 10 of the present invention solves the aforementioned problems by combining the best features of gliders and helicopters into a simple, inexpensive, highly entertaining and educational device. Referring to FIG. 1, the toy includes, generally, a wing 20 mounted to a planar body formed by an elongated longitudinal body spar 40 and a lateral wing spar 50 symmetrically and orthogonally mounted to a forward portion of the body spar 40, and propelled by a rubber band 80 powered propeller 60. As fully described below, the wing is formed in a predetermined shape specially configured for stable ascent and descent.

With continued reference to FIG. 1, the wing 20 of the preferred embodiment is formed in a planar configuration from a thin, lightweight, flexible material and with a planform reminiscent of a swallowtail butterfly. The wing 20 is symmetrical about a longitudinal axis that passes through the body spar 40 and includes a leading edge 22 extending outwards from the longitudinal axis and sloping gradually forward at approximately 80° to the axis. At its respective outer extremities the leading edge turns sharply rearwards to define wing tips 23 that slope slightly inwards at approximately 10° with respect to the longitudinal axis. The wing tips 23 each transition to a cusp 21 located approximately two thirds of the wing tip length aft of the leading edge 22.

The aft-most section of the respective wing tips 23 curve abruptly inward to define an outer trailing edge 25, and finally turn sharply again to angle rearwardly thereby defining respective flanking, V-shaped stabilizers 24 laterally spaced about the longitudinal axis and extending rearwardly and outwardly at approximately 30° with respect to the axis. The inner edges of the two stabilizers 24 form an angle measuring approximately 60° with the apex located on an inner edge 25' of the wing 20, thereby imparting to the wing the aforementioned swallowtail butterfly shape. The wing 20 is broadest across the leading edge 22 where it spans approximately 7.5 inches, narrows down to 5 inches across the outer trailing edges 25, extends 4.75 inches from the leading edge to the outer trailing edge, and measures 7.75 inches from the leading edge to the aft-most extremities of the stabilizers 24.

There are numerous materials available that will offer the requisite flexibility along with sufficient strength to serve as the wing 20. The preferred embodiment incorporates what is known in the trade as UV ULTRA paper of about 17 lbs. weight. This material is very inexpensive, easily cut with scissors, may be imprinted with any type of indicia and colored with practically any type of ink, coloring pen, pencil or paint including computer printer inks and toners. A wing 20 made from UV ULTRA paper is therefore ideally suited for classroom use because students can easily ornament it with various designs or logos, and can also easily alter and customize the shape of the wing to study the effect that various modifications have upon its performance characteristics. Similarly, many types of preprinted designs may be incorporated on the UV ULTRA paper such that no effort is required of the user.

With continued reference to FIG. 1, the wing 20 is affixed to the planar body which is formed with the longitudinal body spar and the lateral wing spar 50 symmetrically and orthogonally mounted to a forward portion of the body spar 40. The body spar 40 extends along the longitudinal axis of the wing 20 from just forward of the outer trailing edge 22, past the rear edge 25, to a point centered between the aft-most extremities of the stabilizers 24. The wing 20 may also be shaped so that the body spar 40 does not extend past the edges of the wing. In the preferred embodiment the body spar 40 is approximately 7.75 inches long, about 0.375 inches high and about 0.125 inches wide. The lateral spar 50 is typically mounted between the body spar 40 and the wing 20 and must be sufficiently aft of the leading edge 22 to allow the leading edge to flex under the incident airstream generated during flight. The wing spar 50 is preferably about four inches long and about 0.125 inches wide, and no more than approximately 0.0625 inches high to minimize the deformation of the wing material above the point where it passes over the intersection point of the body and wing spars, 40 and 50, respectively.

Together the two spars 40 and 50 create a strong, stiff platform for the wing 20 and the propeller 60 assembly, while simultaneously being constructed of light weight materials thereby enhancing the capabilities and performance characteristics of the toy. Balsa wood is the preferred material of construction for the two spars due to its ease of shaping, light weight, and low cost. Furthermore, its familiarity to teachers and school children alike is surpassed by few other materials, if any, and it is widely available in a large number of pre-shaped configurations. Many types of cardboard or plastic materials are also similarly well-suited for the construction of this toy.

In the exemplary embodiment of the present invention, the wing 20 is mounted to the two spars 40 and 50 with a fastening method capable of repeatedly withstanding the aerodynamic forces imposed by ascent and descent. The fastening method facilitates the objective of adequate strength, minimization of the total weight and optimization of the aerodynamic shape of the toy. For this reason, adhesive tape such as cellophane or masking tape is the mounting method of choice. Such tape is easy to work with and safe for use by children, provides sufficient strength, and has a very light weight and low profile that does not adversely impact the wing's aerodynamic profile. Still referring to FIG. 1, tape 46 is preferably attached to the wing 20 and the two spars 40 and 50 at locations positioned across the laterally outermost ends of the spars. The tape 46 is affixed to each surface of the three exposed sides of the spars and extends a sufficient length to attach to an adequate portion of the wing material to prevent separation of the tape from the wing material during flight. A total length of approximately two inches for each piece of tape has been determined to be sufficient when using standard ¾ inch cellophane or masking tape.

Figure 2:
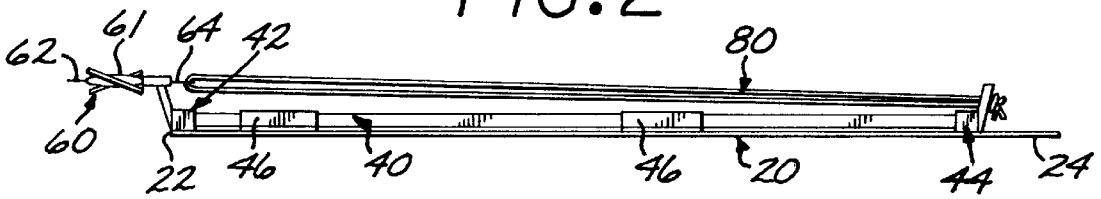
FIG. 2 is a left side view of the flying wing shown in FIG. 1.
Figure 3:
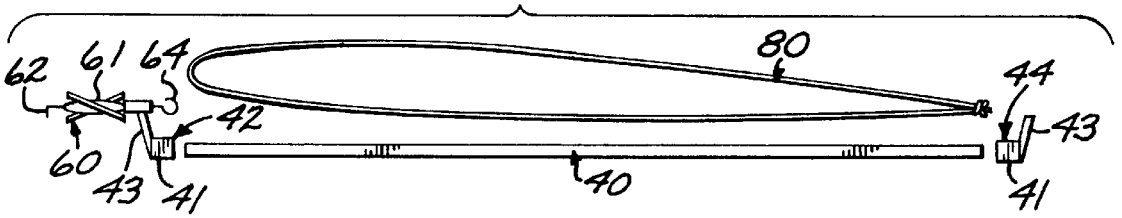
FIG. 3 is an exploded side view of the rubber band, longitudinal beam, and propeller assembly of the flying wing toy shown in FIG. 2.

Referring now to FIGS. 2 and 3, anchors 42 and 44 are installed on the front and tail end of the body spar 40, respectively. The anchors 42 and 44 include sleeves 41 formed to be closed end caps and sized to fit snugly over the ends of the body spar 40, and upwardly projecting struts 43 and 43' respectively, extending from the closed ends of the respective sleeves. Horizontally disposed bushings extend along an upper end of the struts and have a horizontal axis which parallels the longitudinal axis of the wing 20. The anchors 42 and 44 are preferably manufactured from a lightweight plastic that offers a limited degree of flexibility to accommodate slightly thicker beams, and may be formed with horizontally aligned reinforcing ribs.

Propeller 60 is formed with two blades 63 extending laterally outward from a central hub 61 which is configured with a centrally disposed through bore. The propeller 60 is positioned with hub 61 directly ahead of front end anchor 42 so as to remain clear of leading edge 22 during rotation. A crank type propeller shaft 62 is formed from a stiff piece of steel wire or similar material and configured with an open eye, or hook, 64 at its rear end and is rotatably mounted within the bushing of the front end anchor 42 and the through bore of the propeller hub 61. The shaft 62 is formed with a tab that extends in an L-shape at its front end and engages a notch formed in the forward facing side of the hub 61 (not shown). The propeller 60 is formed from a lightweight, stiff but resilient plastic and the two blades 63 preferably extend approximately 3 inches from the hub 61. A propeller with three or more blades would work equally well during powered ascent, but may offer a larger frontal area and thus increased drag during the glide descent. A propeller blade pitch which decreases gradually from the hub 61 to the outward tips from approximately 45 degrees to approximately 20 degrees has been found to generate sufficient thrust for vertical ascent.

Referring to FIG. 3, the final element of the subject invention is comprised of the rubber band 80 which is cut from an endless strip to a predetermined length that is preferably slightly longer than twice the distance between the two main beam anchors 42 and 44. A rubber band 80 of this length will extend between the hook 64 and rear anchor 44 with minimal stretching when attached at its ends to form a circular loop. A typical, preformed circular rubber band would be equally acceptable but a linear rubber band allows the user to more precisely predetermine the length to adjust the tension in the rubber band and thereby the torque transmitted to the propeller, an important consideration in an experimental, educational setting such as a classroom.

Referring once again to FIG. 2, in operation the user will first form rubber band 80 into a circular loop by tying a knot at its free ends. By adjusting the length of the loop, the user can vary the amount of tension that the rubber band 80 will experience when it is wound up and thus the amount of propulsive power available. The user next installs the rubber band to the toy by attaching one end to the hook 64 and the other end to strut 43 of the tail anchor 44. The amount of tension in the rubber band in the installed but unwound position is determined by the length of the closed loop formed when it is installed as described. Ideally, this length should be just enough to prevent the band from slipping off of the hook 64 and the strut 43'. In this position the rubber band is thus aligned along, and just slightly above, the body spar 40. The preferred embodiment employs a rubber band of, as illustrative for an example, approximately 17" in length for an installed loop length of about 7.25", 3/16 inch in width, and 1/16 inch in height, which offers adequate propulsion to, when wound up to approximately 150 turns or more, drive the toy to heights of over forty feet. The rubber band may, however, be wound up to 500 turns or more to propel the toy to altitudes of over 300 feet.

Figure 4:
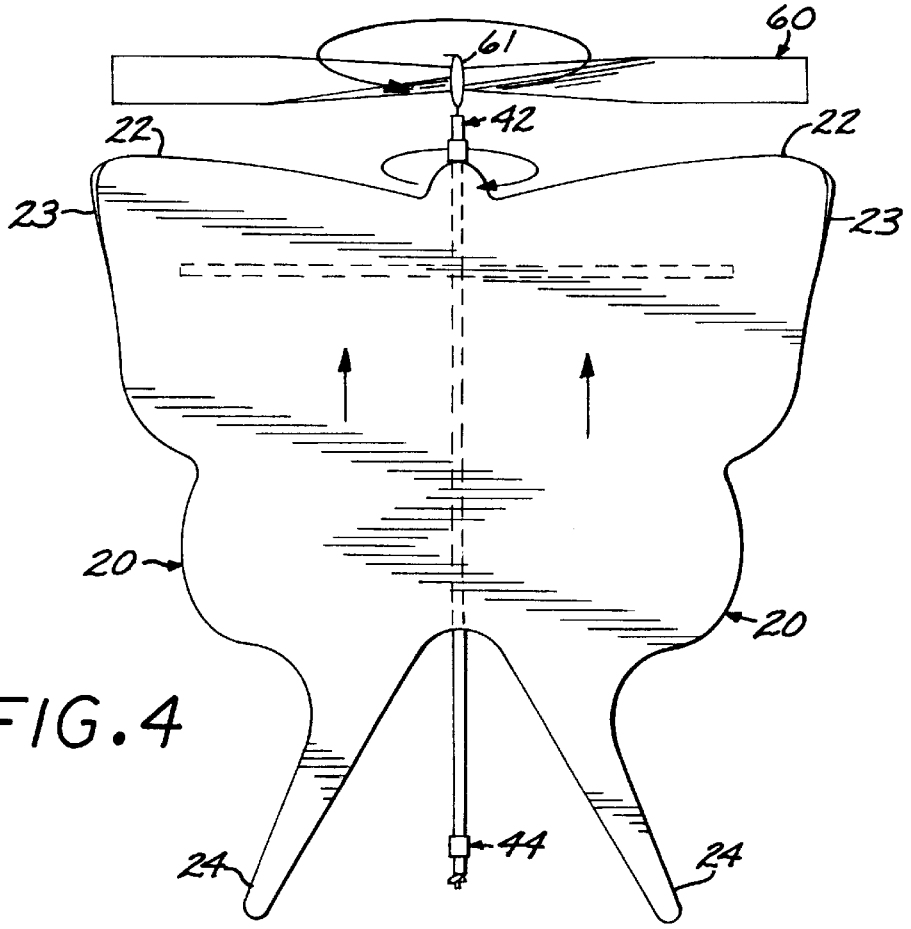
FIG. 4 is a top view, in reduced scale, of the flying wing toy shown in FIG. 1 during vertical ascent.

In operation, an operator may grasp the body spar 40, preferably near the center, with one hand and with the other hand wind up the propeller 60 in either a clockwise or a counterclockwise direction, as dictated by the pitch of the propeller blades, thereby winding the rubber band 80 to store rotational energy. Referring to FIG. 4, the toy is now ready to fly and the user must simply release both hands at the same time while giving the toy a gentle upward push. As the rubber band 80 begins to unwind, it drives the hook 64 attached to its front end to turn around its axis, thereby imparting rotational motion to the crank 62 and the propeller 60. As the propeller picks up speed, a flow of air is created through the propeller blades 63 which is directed rearwardly towards the wing 20, thereby generating upward thrust that overcomes the downward pull of gravity and causes the toy to ascend vertically until all the tension in the wound up rubber band 80 has been released. When the rubber band has finished unwinding, the propeller will stop rotating and the toy will again be under the influence of gravity.

The ascent of the toy 10 follows a nearly linear vertical path due to the stabilizing effect of the counter rotation of the wing 20 during ascent. This counter rotation motion is caused by the fact that as the rubber band 80 unwinds, the two ends of the rubber band tend to rotate in opposite directions. Thus as the front end of the rubber band 80 rotates, and thereby causes the propeller 60 to spin in one direction, the aft end of the rubber band rotates in the opposite direction. Simultaneously, the toy pitches upwardly, since the center of gravity is aft of the thrust vector of the toy and begins ascending vertically. As ascent continues, because the aft end of the rubber band 80 is attached to the tail anchor 44, the countervailing rotational motion of the rubber band's tail end is transmitted to the body of the toy 10, thereby causing the body of the toy, including the wing 20, to rotate. Because the wing 20 has a much larger surface area than the propeller blades 63, the body of the toy 10 rotates at a much slower rate than the propeller 60. This counterposed, albeit slow, rotation of the wing 20 causes a combination stabilizing effect due to a small gyroscopic effect and a larger planform drag effect. The platform drag acts as a two way stabilizer during the vertical ascent. First, it acts along the entire longitudinally extending surface of the wing 20 to push against the surrounding air as the wing spirals upward. Second, the planform of the wing 20 acts to counter the rearwardly spiraling propeller airstream, or prop wash. Both actions serve to stabilize the vertical ascent flight path even under relatively adverse conditions such as crosswinds.

An important feature of the present invention is that the design of the toy 10 ensures a vertical ascent even if the toy is initially released in a less than vertical stance. Although the toy will perform better if initially pointed up and launched with a gentle upwards push, the thrust generated by the propeller 60 in combination with the center of gravity location will eventually cause the toy to turn skyward even if the toy is released from a horizontal position. If released horizontally, the toy will fly along a horizontal path for a short distance and will then pitch upwards and begin ascending vertically. For horizontal release, it is advisable that sufficient horizontal space be provided for the toy to initiate its vertical flight path.

Figure 5:
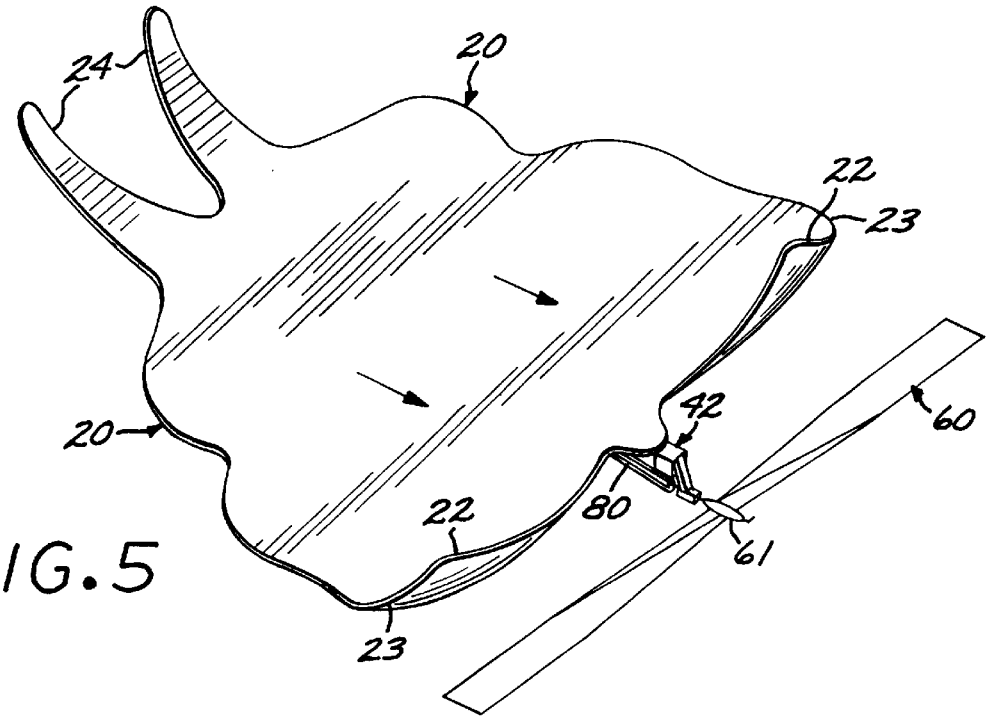
FIG. 5 is a perspective view, in reduced scale, of the flying wing toy shown in FIG. 1 during gliding descent.

Once the rubber band 80 has unwound completely, the propeller 60 will cease to turn and the toy 10 will have reached the apex of its vertical trajectory. Referring now to FIG. 5, the center of gravity of the toy, absent the propeller thrust, will cause the nose of the toy to begin to pitch downwardly. Because the center of gravity is located below the wing, the toy will always, during horizontal glide flight, roll so that the lifting surface of the wing faces upward. As the toy begins a gliding descent and pitches downwardly, air begins to flow over the wing 20, across the leading edges 22 and towards the trailing edges 25 and 25'. In this orientation, the wing 60 acts as an airfoil with a center of pressure close to the center of gravity such that the wing assumes a positive angle of attack causing a portion of the airstream to move over the top of the wing 60 at a higher velocity than the portion of the airstream moving underneath the wing 60. This, in simple terms, describes the effect known as lift, wherein the faster moving air stream on top of the wing 60 creates a lower pressure region above the wing in contrast to a higher pressure region below the wing due to the slower moving airstream. This pressure differential creates a net lifting effect on the wing.

In this way, sufficient lift is generated to cause the toy 10 to glide a substantial horizontal distance, while descending vertically and returning to the ground. The user may be instructed to, in very small increments, adjust the position of the wing 20 forward or rearward as it is mounted to the spars 40 and 50 such that the effective angle of attack is adjusted to vary the net lift of the wing 20. The glide slope of the descent flight is defined to be the angle between the horizontal and the descent flight path, and it changes in direct correlation to the angle of attack. The smaller the glide slope, the further the toy will travel. By slightly adjusting the wing 20 forward or rearward to vary the the angle of attack, the glide slope can be varied. Such adjustments can effectively demonstrate, in very simple terms, some relatively complex aerodynamic principles including lift, angle of attack, drag and glide versus powered flight principles. This capability makes the flying toy of the present invention an exceptional education tool.

The pressure differential experienced during descent also causes the flexible leading edge 22, wing tips 23, and flanking stabilizers 24 to flex upwards with respect to the wing surface. The angle of attack is also affected by the upward flexure of the leading edge 22 which forces the air stream to separate from a small portion of the leading edge wing surface creating an area of reduced air pressure immediately behind the leading edge 22. The upward flexure also creates a small amount of drag which, in combination with the reduced pressure, acts to slightly rotate the toy in a nose up direction to further increase the angle of attack and thereby increase lift which improves the horizontal glide distance. At the same time, the stabilizers 24 will be flexing up to follow the naturally flowing air stream past the wing 20, thereby acting to prevent early separation of the laminar air flow from the top of the wing surface while simultaneously reducing turbulent air flow behind the wing rear edge 25, which, in combination, decreases resultant drag and improves glide performance. Therefore, the flexible leading edge 22 and stabilizers 24 act in concert during descent to maximize lift, and minimize the glide slope to thereby maximize glide distance. In addition, the flanking configuration of the stabilizers 24 around the wing's yaw axis produces a small, symmetrical drag force on the toy, which serves to directionally stabilize the toy around its yaw axis and resulting in a smooth, linear glide flight path.

The lateral outboard edges 23 of the wing 20 will also flex upwards during descent. This upward flexure creates what are commonly termed winglets. These winglets 23 are best understood from FIG. 5 and are known to contribute to lift by decreasing the amount of air which, during glide flight, flows from the higher pressure region below the wing 20 to the lower pressure region above the wing 20 by passing around the outboard edges 23. This effect of air movement is known as wingtip vortex air flow which increases drag and decreases the performance of the wing 20 to the extent it is not prevented. Additionally, the winglets 23 and the stabilizers 24 in effect act to, during glide flight, create what is known to those with skill in the art as a wing dihedral angle. The wing dihedral angle contributes an important stabilizing effect about the toy's roll axis in that it modifies the effective net lift of the wing 20 by creating a small horizontal component to the otherwise vertically directed lifting forces. This small horizontal component is conventionally positioned at the respective center of pressure of each winglet 23 and stabilizer 24 and is directed horizontally towards the longitudinal axis of the toy 10. This has the effect of causing the wing 20 to fly in a straight and level gliding flight path. Variation on the exemplary embodiment can incorporate winglets 23 and or stabilizers 24 which are pre-shaped to independently or cooperatively project upwardly or downwardly thereby causing the toy 10 to seek a more leftward or rightward flight path trajectory. Such variations can be also employed to affect both the vertical ascent and horizontal descent flight paths. The amount of flexure in the lateral edges 23 is determined by the flexibility of the wing material as well as the length of the body spar 50, which is attached to the wing 20 with tape affixed to its ends. A longer wing spar 50 will extend closer to the wing tips and thus prevent them from flexing upwards, whereas a shorter beam will allow more freedom of flexure.

In an alternate embodiment or variation of the exemplary embodiment of the present invention, the wing 20 may be, as mentioned above, shaped with lateral edges 23 formed at preselected equal dihedral angles with respect to the surface of the wing. By bending the lateral edges upwards at different angles the user may alter the natural roll characteristics of the toy during ascent and descent. In addition, by configuring the stabilizers 24 to have different shapes and different total areas, the user can also easily impart the wing 20 with varying degrees of left or right bias around its yaw axis. Thus in another alternative embodiment the stabilizers may be formed from a semi-flexible material that the user may fix at any predetermined angle with respect to the wing 20, thereby achieving the same left or right biasing result attributed to the lateral edges 23. Such features greatly enhance the flexibility and educational value of the present invention without a detrimental impact upon the cost or simplicity of the toy.

Figure 6:
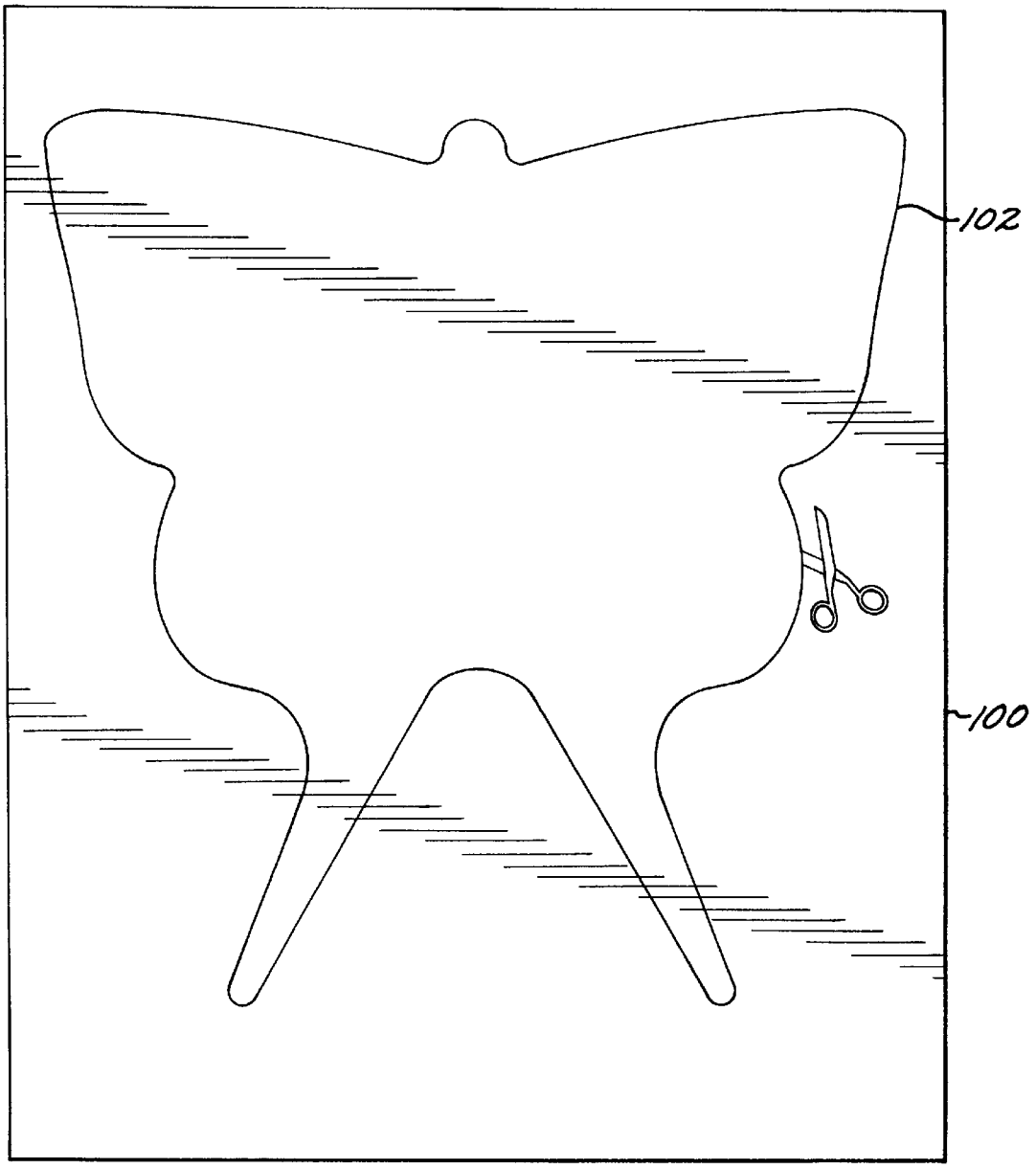
FIG. 6 is a top view of a sheet of paper incorporating the wing of the toy shown in FIG. 1.

Referring once again to FIG. 1 and 3, the preferred embodiment of the present invention is provided to the user in an unassembled kit form consisting of the two spars 40 and 50 cut to the preferred length, the rubber band 80, the tail anchor 44, and the propeller assembly consisting of the propeller 60 mounted on the shaft 62 and pre-mounted to the front anchor 42. Referring to FIG. 6, the wing 20 is provided in the form of a sheet of paper 100 with the outline 102 of the preferred wing shape imprinted thereon so the user may cut out the wing with a pair of scissors or other suitable implement. This approach greatly reduces the cost of the toy, simplifies the assembly process for the end user, provides a great deal of flexibility by enabling the user to customize the planform of the wing 20 and to thereby experiment with different shapes and sizes, and allows the user to decorate the wing more easily and with less chance of inadvertent damage.

Figure 7:
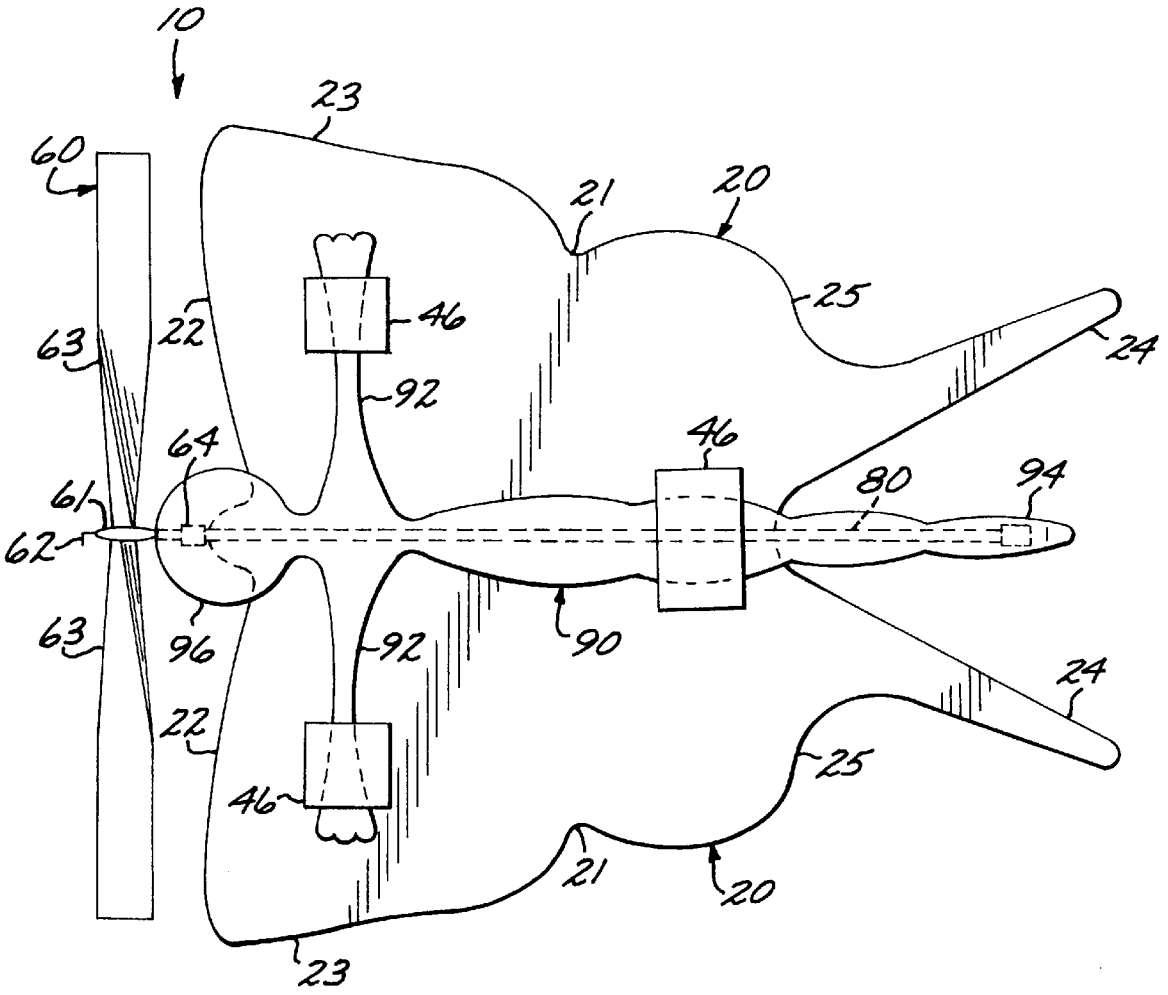
FIG. 7 is a top view of a flying wing toy as shown in FIG. 1 incorporating a precast monolithic body.

As previously disclosed, the choice of balsa wood for the spars 40 and 50 was dictated largely by cost and ease of use factors. However, it must be understood that a wide variety of other materials may be used to form the body of the present invention. In an alternate embodiment, for example, the body may be formed from hollow plastic spars or beams, or may be cast as a single monolithic piece adapted to reduce its weight and increase its rigidity and strength. As shown in FIG. 7, a monolithic body 90 could be shaped, for instance, as a figure with an elongated torso 94 to act as the main spar 40, two outstretched arms 92 to fulfill the function of the wing spar 50, and a head 96 incorporating a bore to rotatably receive the propeller shaft 62 therethrough. The body 90 may be formed with a flat upper surface to contact the surface of the wing 20, and either a flat or a contoured lower surface. A contoured lower surface will impact the aerodynamic performance of the toy 10 during ascent, but not significantly. Such a preformed body may be more attractive to young children, more durable, and more foolproof during assembly. A typical body may also be formed with beams with various cross sectional designs, such as triangular or oval, thereby further enhancing the educational value of the toy by demonstrating the benefits of different cross-sectional configurations and some basic structural mechanics concepts. Finally, the present invention may be configured as a ready-to-use toy that requires no assembly whatsoever, in which case the body and wing may be injection molded as one structure with the wing formed integral to the body.

Similarly, while the choice of UV ULTRA paper for the wing 20 material was also dictated largely by economic considerations, it is understood that other widely available materials may also be used with equally satisfactory results. Many types of thin thermoplastic, flexible films are quite suitable for use in fabricating the wing 20. Such films include, but are not limited to acetates, poly-sthylene, terephthalates and other polymers, and flexible polymeric and elastomeric materials. The user may experiment with films of various thicknesses and flexibility to achieve a wide range of performance characteristics and/or wing designs and shapes. Furthermore, the wing 20 sold in kit form 100 may be blank to facilitate user imprinting or may be preprinted with a large variety of ornamental designs, such as a butterfly, a superhero, a rocket ship, an airplane, and various logos and insignias.

From the foregoing, it will be appreciated that the toy of the present invention provides a highly entertaining and very cost effective educational tool that may be employed by school teachers to teach their student a wide variety of physical concepts. The low cost of the device makes it affordable enough to provide an individual toy to each student, and the preferred kit form affords the students hands-on experience in assembling, repairing, and modifying the toy. The present invention achieves these objectives with a simple device that balances various competing aerodynamic factors into an elegant solution optimized for use in the classroom.

While a particular embodiment of the invention has been illustrated and described, various modifications can be made without departing from the spirit and scope of the invention, and all such modifications and equivalents are intended to be covered.

What is claimed is:

1. A flying wing toy comprising:

a flexible wing sheet defining a wing body symmetrical about a longitudinal roll axis and formed with a leading section projecting forwardly to terminate in respective leading edges; and a rigid longitudinal body affixed to said wing and extending along said roll axis to provide structural support to said wing; and a wing spar, projecting laterally to said body, affixed to said wing section at a predetermined distance behind the respective said leading edges to leave said leading sections free to flex upwardly to impart positive pitch to said wing relative to a latitudinal pitch axis; and a propeller rotationally mounted on the front end of said longitudinal body anterior to said leading edge; and a drive unit including an energy storage device mounted to said body and coupled to said propeller to rotationally drive said propeller, whereby said energy storage device is actuated to store energy for driving said propeller and when said propeller is released to rotate and drive said Flying Wing Toy forwardly to climb upwardly such that when said toy reaches the top of said climb and pitches over to start it descent said leading edges will flare upwardly relative to said spar to cause air flowing over said wing section to impart a positive pitch to said toy to cause said toy to descend with a relatively low angle of attack glide path.

2. A flying wing toy as set forth in claim 1, wherein:

said leading edges are deformably configurable such that said edges will take a permanent set and may be curved radially upwardly in user selected increments thereby selectively increasing the degree of positive pitch imparted to said wing relative to said pitch axis.

3. A flying wing toy as set forth in claim 1, wherein:

said wing sections are configured to project laterally beyond the ends of said spar to form respective flexible winglets.

4. A flying wing toy as set forth in claim 3, wherein:

said winglets are deformably configurable such that said edges will take a permanent set and may be formed upwardly at user selected angles to form winglets thereby selectively changing the lift characteristics of said wing.

5. A flying wing toy as set forth in claim 1, wherein:

said sheet includes a pair of flanking flexible stabilizers disposed on opposite sides of said roll axis and projecting rearwardly to form rear extremities free to flex and project upwardly relative to said wing body so that as said toy glides through its descent said stabilizers will flex upwardly into the partial vacuum created by laminar air flow over said wing to stabilize said wing about a vertical yaw axis.

6. A flying wing toy as set forth in claim 5, wherein:

said stabilizers are deformably configurable such that said stabilizers will take a permanent set and may be individually bent upwardly at user selected angles thereby selectively changing the yaw characteristics of said flying wing toy, whereby a user may create a drag differential by bending one of said stabilizers into a position higher than the other of said stabilizers, thereby causing said flying wing toy to yaw, or turn, in the direction of the higher stabilizer.

7. A flying wing toy as set forth in claim 1, wherein:

said toy is configured with a center of gravity disposed at a predetermined location and is further configured with an aerodynamic center of pressure located aft of said center of gravity thereby imparting positive pitch to said toy during horizontal flight, so that if said toy is released in a horizontal position with said energy storage unit driving said propeller to propel said toy forwardly, said toy will ascend vertically after a limited duration of horizontal flight.

8. A flying wing toy as set forth in claim 1, wherein:

said wing spar is disposed between said longitudinal body and said wing.

9. A flying wing toy as set forth in claim 1, wherein:

said energy storage device comprises a manually actuated elastic member including two ends twistable in opposing circular directions and capable of storing rotational energy in the form of torsion, said two ends being attached to said propeller and the rear end of said body, respectively, to impart said body and said propeller with torsionally opposing rotational motion when releasing said rotational energy.

10. A flying wing toy as set forth in claim 1, wherein:

said sheet is preformed in the contour of a swallowtail butterfly.

11. A flying wing toy as set forth in claim 1, wherein:

said body and said wing spar are mounted to said wing with adhesive material.

12. A flying wing toy as set forth in claim 1, wherein:

said wing sheet is constructed of paper.

13. A flying wing toy as set forth in claim 1, wherein:

said wing sheet is constructed of UV Ultra paper.

14. A flying wing toy as set forth in claim 1, wherein:

said leading sections are configured to define said leading edges laterally outwardly and forwardly of said longitudinal body.

15. A flying wing toy as set forth in claim 1, wherein:

said wing sheet is configured with said leading sections defining said leading edges to curve laterally outwardly and forwardly from said longitudinal body to respective laterally outwardly curving wing tips to define respective peripheral edges angling aft and inboard.

16. A flying wing toy as set forth in claim 1, wherein:

said wing body and leading sections are integral with one another.

17. A flying wing toy as set forth in claim 1, wherein:

said stabilizers are configured to angle aft and outboard from one another.

18. A toy airplane comprising:

a one-piece flexible sheet formed at its forward extremity with a transversely projecting wing section having a forwardly disposed flexible leading edge section, said sheet tapering aft and inboard from said wing section along its opposite outboard edges, said sheet being further formed with a pair of rearwardly projecting laterally spaced apart stabilizers;

a transverse balsa wood spar stick disposed under said wing section;

a longitudinally projecting balsa wood spar stick disposed centrally under said sheet;

adhesive tape strips securing the opposite ends of said transverse spar stick and said longitudinal stick to the underside of said sheet to be suspended therefrom;

a hub fitting fitted over the forward end of said longitudinal stick and rotatably mounting a propeller therefrom; and an elastic band secured between said propeller and the aft end of said longitudinal stick for storing energy therein for rotation of said propeller.

19. A flying wing toy kit, comprising:

a flexible sheet of wing material configured with contoured edges to form a wing symmetrical about a longitudinal roll axis with leading edges, lateral edges, and rearwardly extending, flanking stabilizers laterally spaced apart about said roll axis and free to flex at the rear extremities into the partial vacuum created by a laminar air flow over said wing to stabilize said wing about a vertical yaw axis and to impart positive pitch to said wing relative to a latitudinal pitch axis;

a frame including a longitudinal body to be positioned along said roll axis of said wing and a wing spar of predetermined length disposed at right angles to said longitudinal body to be positioned at a predetermined distance behind said leading edge to allow said leading edge to flex into said vacuum to impart positive pitch to said wing about said pitch axis, said wing spar to be further positioned between said lateral edges to allow said lateral edges to flex into said vacuum to stabilize said wing about said roll axis;

attachment means to attach said frame members to said wing member;

a propeller rotatably mountable to the fore end of said longitudinal body;

an anchor to mount to the aft end of said longitudinal body; and an elastic band for connection to said propeller and to said anchor, said band being torsionally deformable to store energy therein.

20. A flying wing toy kit as set forth in claim 19, wherein:

said leading edges are deformably configurable such that said edges will take a permanent set and may be curved radially upwardly in user selected increments thereby selectively increasing the degree of positive pitch imparted to said wing relative to said pitch axis, whereby a user may gain an intuitive understanding of the relationship between the positive pitch imparted to the wing and the rate of descent of said flying wing toy in horizontal flight.

21. A flying wing toy kit as set forth in claim 19, wherein:

said lateral edges are deformably configurable such that said edges will take a permanent set and may be formed upwardly at user selected angles to form winglets thereby selectively changing the lift characteristics of said wing, whereby a user may gain an intuitive understanding of the effect of a winglet on the termination of laminar airflow at a wingtip and of the resultant effect on the lift of said wing.

22. A flying wing toy kit as set forth in claim 19, wherein:

said stabilizers are deformably configurable such that said stabilizers will take a permanent set and may be individually bent upwardly at user selected angles thereby selectively changing the yaw characteristics of said flying wing toy, whereby a user may create a drag differential by bending one of said stabilizers into a position higher than the other of said stabilizers, thereby causing said flying wing toy to yaw or turn in the direction of the higher stabilizer.

23. A flying wing toy kit as set forth in claim 19, wherein:

said toy is configured with a center of gravity disposed at a predetermined location and is further configured with an aerodynamic center of pressure located aft of said center of gravity thereby imparting positive pitch to said toy during horizontal flight, so that if said toy is released in a horizontal position with said energy storage unit driving said propeller to propel said toy forwardly, said toy will ascend vertically after a limited duration of horizontal flight.

24. A flying wing toy kit as set forth in claim 19, wherein:

said attachment means comprise adhesive material.

25. A flying wing toy kit as set forth in claim 19, wherein:

said contoured edges are in the form of a swallowtail butterfly.

26. A flying wing toy kit as set forth in claim 19, wherein:

said contoured edges are printed upon said sheet.

27. A method for constructing a toy airplane comprising the steps of:

selecting a flexible sheet of material configured with contoured edges to form a wing symmetrical about a longitudinal roll axis, including flexible leading edges, lateral edges and a body having rearwardly extending stabilizers;

selecting a balsa wood stick of predetermined length to form a wing spar;

mounting said wing spar to said wing laterally to said roll axis, aft of said leading edges;

selecting a balsa wood stick configured to form a longitudinal body;

mounting said longitudinal body to said wing along said roll axis such that said longitudinal body passes over said wing spar;

selecting a propeller;

attaching said propeller to said longitudinal body, by a propeller mount;

selecting an anchor;

mounting said anchor to said longitudinal body spaced from said propeller mount;

coupling an elastic band to said propeller and to said anchor.

* * * * *